US005941622A

United States Patent [19]

Davidson et al.

[11] Patent Number: 5,941,622

[45] Date of Patent: Aug. 24, 1999

[54] END MEMBER FOR FOOD DISPLAY CASE

[76] Inventors: Duane G. Davidson; Joseph R. Humphrey, both of 1329 Lake St., Niles, Mich. 46120

[21] Appl. No.: 08/907,996

[22] Filed: Aug. 12, 1997

[51] Int. Cl.[6] ..... A47B 91/00

[52] U.S. Cl. ..... 312/400; 312/406.2; 52/797.1; 52/794.1

[58] Field of Search ..... 108/27, 161; 312/406.2, 312/406, 140.1, 140.2, 140.3, 140.4, 400, 401; 52/792.11, 796.12, 797.1, 802.1, 802.11, 794.1, 717.04, 718.03, 718.05, 716.6, 716.7; 49/489.1, 501

[56] References Cited

U.S. PATENT DOCUMENTS

| | | | |
|---|---|---|---|
| 2,278,331 | 3/1942 | Meyercord | 52/792.11 |
| 2,644,605 | 7/1953 | Palmer | 312/406.2 |
| 4,386,482 | 6/1983 | Quinif | 49/489.1 |
| 5,289,657 | 3/1994 | Kiel | 49/489.1 |

FOREIGN PATENT DOCUMENTS

| | | | |
|---|---|---|---|
| 96588 | 12/1983 | European Pat. Off. | 49/489.1 |

*Primary Examiner*—Peter M. Cuomo
*Assistant Examiner*—Gerald A. Anderson
*Attorney, Agent, or Firm*—Baker & Daniels

[57] ABSTRACT

An end member or "patch end" of a supermarket food display case includes a pair of substantially parallel panels and an insert extending around the periphery of the panels that interconnects the panels. A foamed insulation material is installed in the cavity defined by the insert and the panels. A decorative strip covers the insert and is releasably attached to the insert so that the decorative strip can be installed, removed, and replaced as necessary to conform to different color schemes.

8 Claims, 8 Drawing Sheets

END MEMBER FOR FOOD DISPLAY CASE

This invention relates to an end member or "patch end" of a supermarket food display case.

Typical supermarkets use refrigerated food display cases to display both fresh and frozen food sold by the supermarket. For example, dairy cases, meat cases, produce cases, freezer cases and service cases all are commonly used in a typically super market. These display cases are typically manufactured in lengths of a few feet, but cases are normally installed in much longer lengths by stringing the individual cases together, with end members or "patch ends" at both ends of the supermarket display case runs. These end members or "patch ends" are compatible in color, contour, and external and internal surfaces with the rest of the supermarket display case, are typically 1½–2 inches thick, and are made with metal interior and exterior surfaces, but other flat material such as plastic laminates have more recently been used. Various colors and finishes are applied to both the external and internal surfaces of these end members. Traditionally, a trim piece is installed around the exterior surfaces of the end member between the inner and outer panels of the end member. These pieces are commonly chromed or made out of aluminum or stainless steel, and are pop riveted to the internal and external surfaces of the end member. Quite often, sharp edges are present and metal burrs are exposed to supermarket customers.

According to the present invention, end members with nonmetallic components are used, and trim pieces along the edge of the patch end may be applied after the end member has been manufactured and may be removed and replaced when necessary, or when the color scheme used in the supermarket is changed. The end members or patch ends are made by a unique process which allows an insulation material to be foamed in place, instead of the more conventional block formed insulation material heretofore used. The end member includes an inner panel, an outer panel, and a flexible plastic insert that connects the panels. The insert includes a recess which captures a projecting portion of a decorative trim strip, for example, vinyl trim material. Both the plastic insert and the vinyl trim materials are flexible, and the trim material may be installed as the last step of the construction of the end member or removed and replaced if a different colored trim is desired.

During manufacture, the flexible insert is arranged around the periphery of the panels in a jig, and apertures are provided in the insert so that foam insulation material can be injected directly into the cavity defined by the panels and the insert. Accordingly, construction is simplified, since the patch end or termination end units may be manufactured and the decorative trim strip added later. The trim strip may also be removed and replaced if it is found that the color match for the supermarket color scheme is not correct or replaced when necessary for other reasons, such a change in the supermarket color scheme. Since no exposed edges are present, burrs and sharp edges are eliminated, thereby eliminating possible injury to supermarket customers.

These and other advantages of the present invention will become apparent from the following description, with reference to the accompanying drawings, in which.

Figure 1:
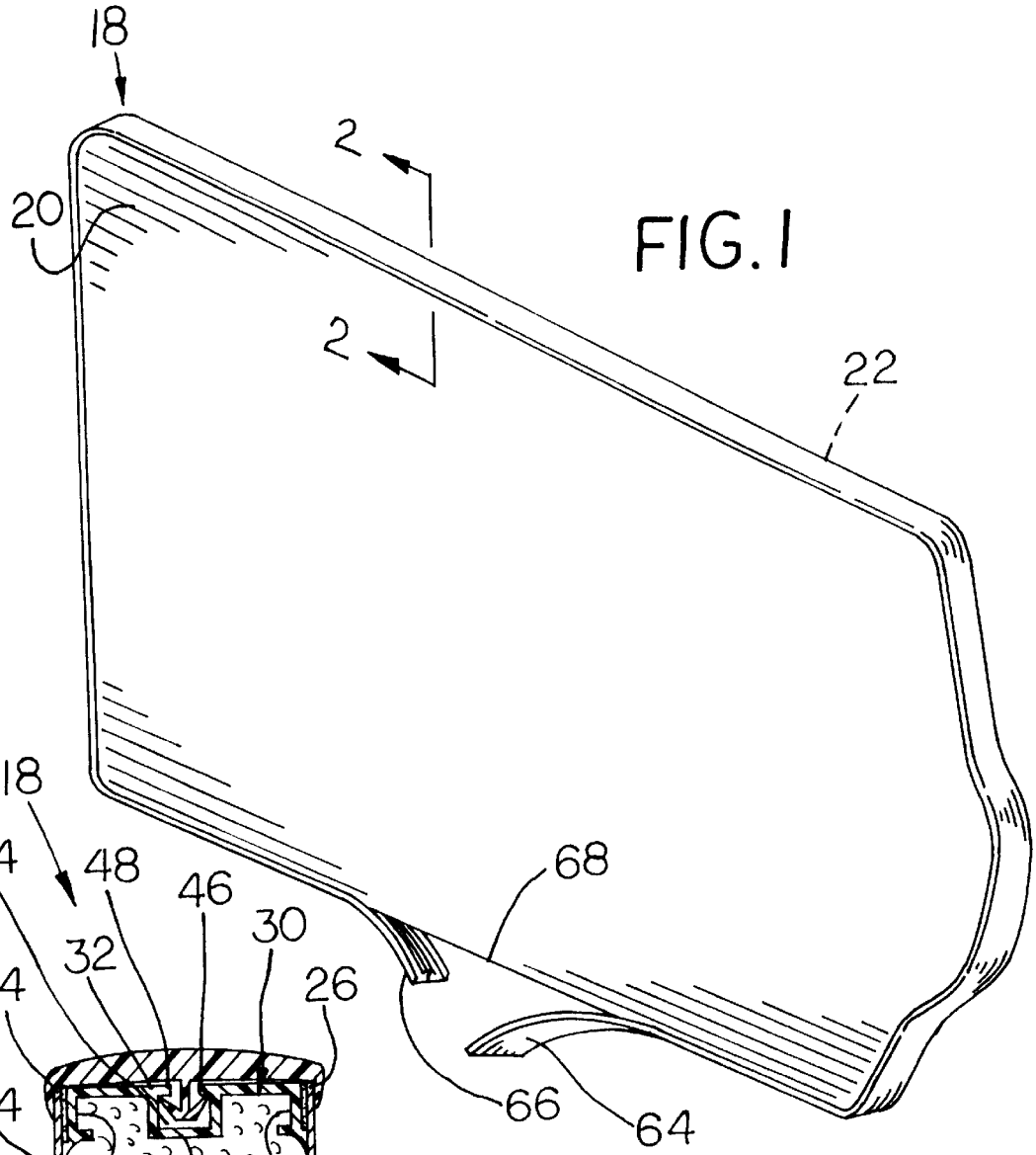
FIG. 1 is a view in perspective of a end member or "patch end" made pursuant to the teachings of the present invention.
Figure 2:
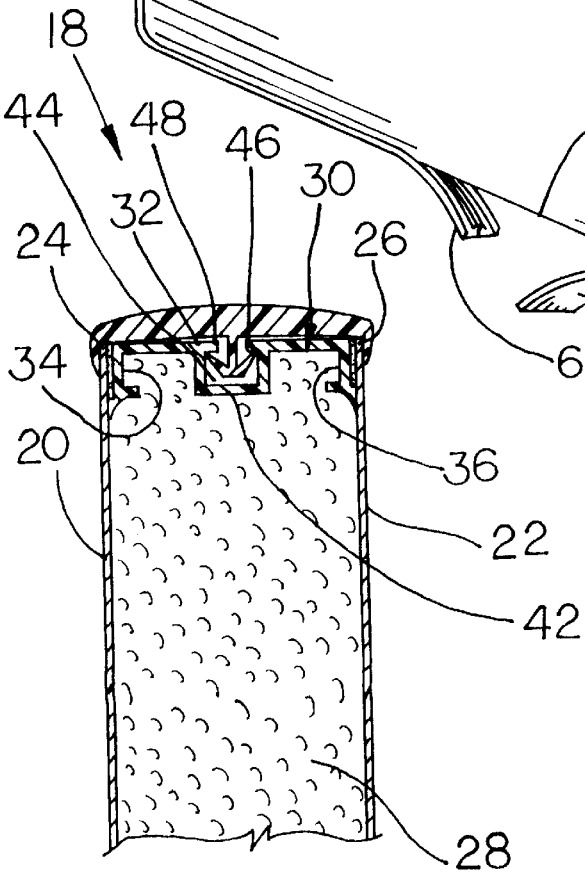
FIG. 2 is a fragmentary cross sectional view taken substantially along 2—2 of FIG. 1.
Figure 3:
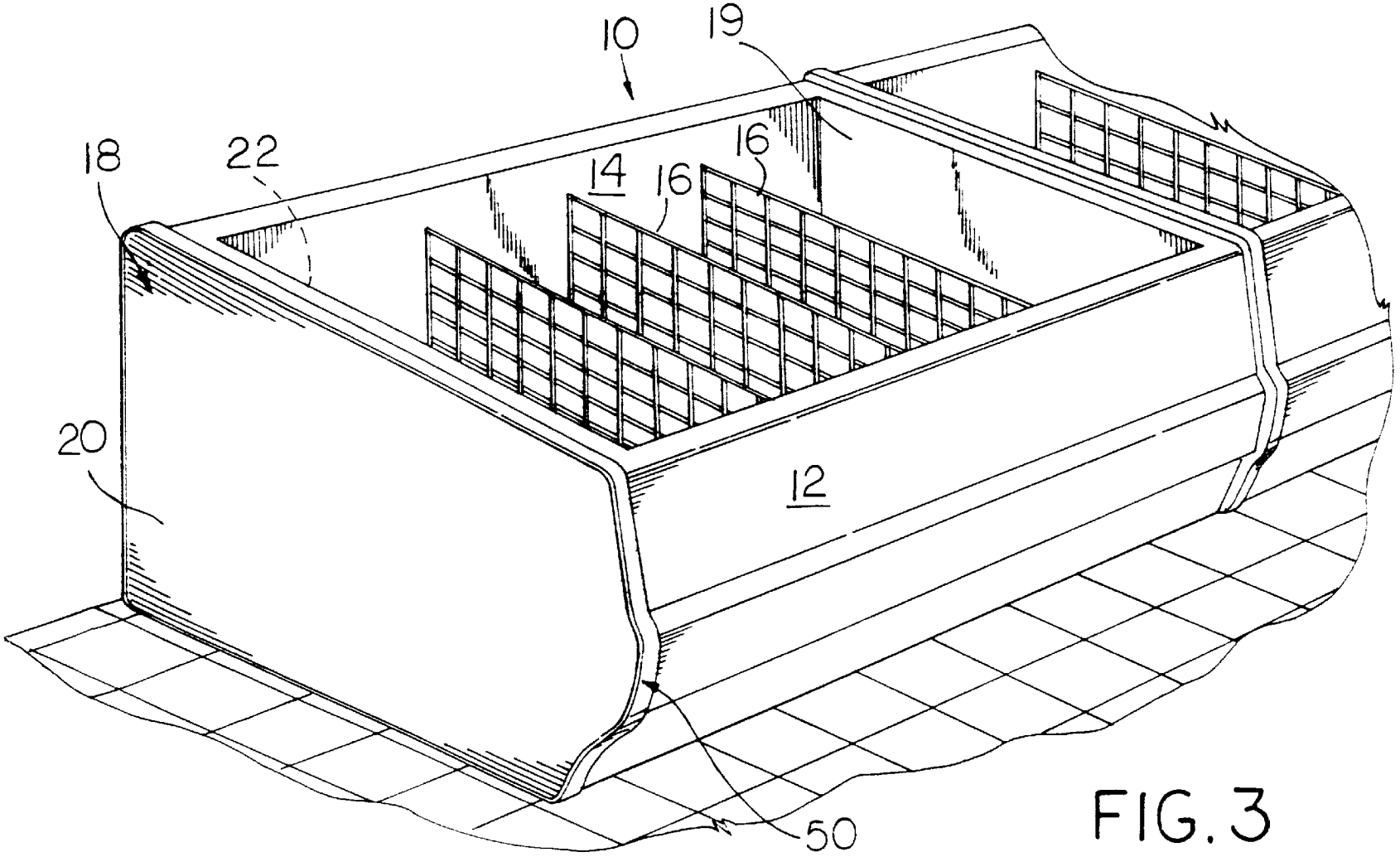
FIG. 3 is a fragmentary view in perspective of a supermarket display case using the end member or patch end of the present invention.
Figure 4:
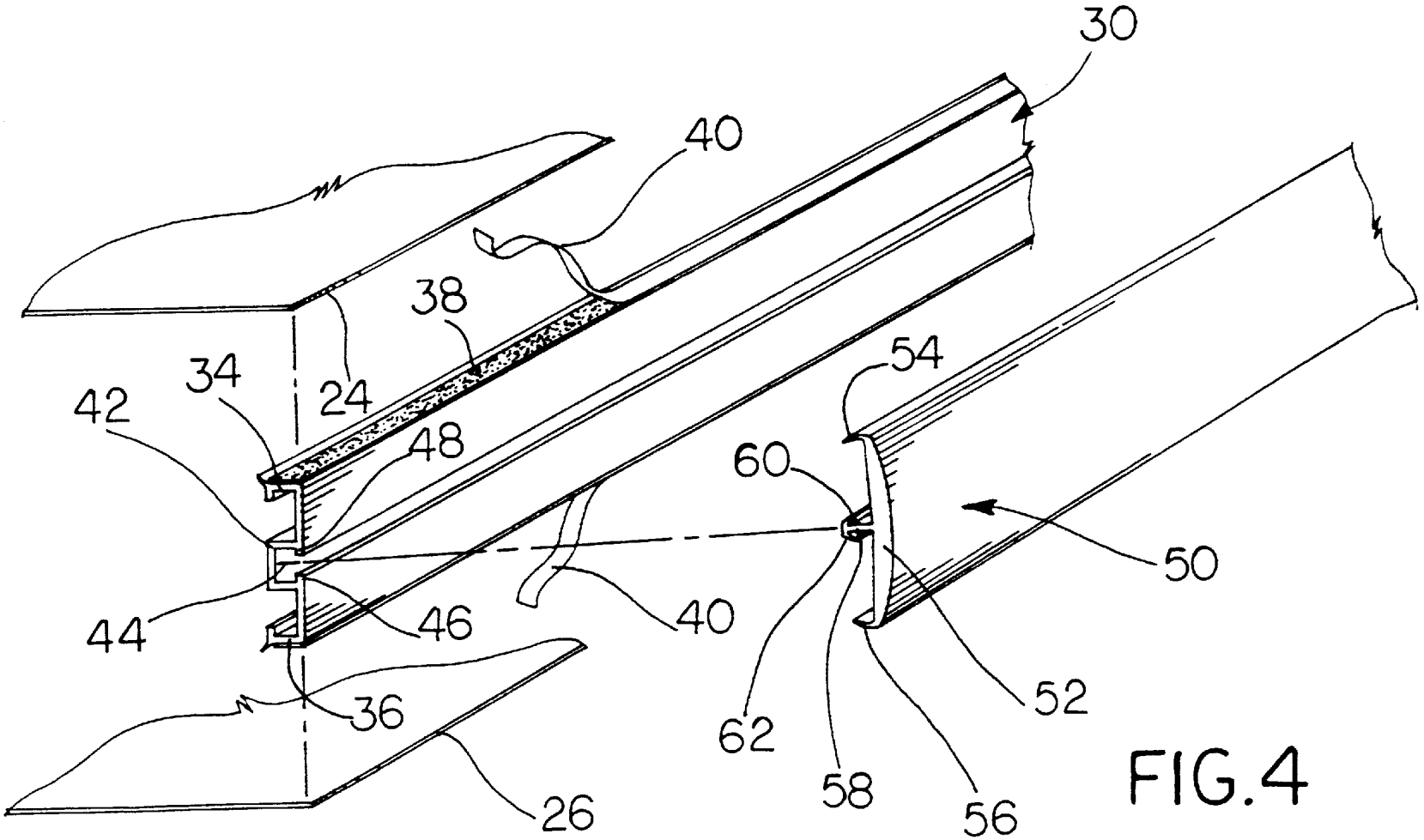
FIG. 4 is a fragmentary exploded view in perspective of the inner and outer panels, the flexible insert, and the trim strip used as a part of the present invention.

Referring now to FIGS. 1–4 of the drawings, a supermarket food display case is generally indicated by the numeral 10 and includes a longitudinally extending front wall 12, a longitudinally extending rear wall 14, a transversely extending end member generally indicated by the numeral 18, and a transversely extending wall 19, which cooperate to define a food storage area in which refrigerated or frozen food products are displayed. Dividers 16 divide the volume into sections. As discussed above, food display cases 10 are generally manufactured in units of a few feet in length, but may be joined together with other units to provide a display case of the desired length. The end member, commonly called a "patch end" by those skilled in the art, is indicated at 18 and terminates the run of display cases. The end member 18 is normally 1½–2 inches thick and is compatible with the contours of the display cases. The end member 18 includes an outer panel 20 and an inner panel 22 which are substantially parallel to one another and include an outer edge 24, 26 which are offset from one another by foam insulation 28 (which also fastens the panels 20, 22 together) and by a flexible insert 30. The panels 20, 22 may be made from steel, plastic laminate and/or other suitable material, and are colored to conform with the color scheme of the unit 10. The insert 30 is made from a semi-rigid material, such as vinyl, and includes a transversely extending portion 32 which extends between the panels 20 and 22 and cooperates with the latter to define the cavity in which the foam insulating material 28 is installed.

Insert 30 further includes a pair of inwardly extending portions 34, 36 that extend inwardly a short distance alongside the panels 20 and 22. The inwardly extending portions 34, 36 are is provided with an adhesive strip 38 which is protected by a strip of paper 40, which is removed when the insert 30 is installed to hold the insert 30 in place. Accordingly, the insert 30 extends completely around the perimeter of the panels 20, 22. The transversely extending portion 32 includes an inwardly projecting recess 42 that projects into the cavity in which the foam 28 is installed. The recess 42 defines a cavity 44, and rims 46, 48 project into the cavity 44.

A flexible decorative strip generally indicated by the numeral 50 extends around the perimeter of the end member 18 and covers the insert 30. Preferably, the decorative strip 50 is made out of vinyl or a similar material, and can be made available in a wide variety of colors which are compatible with various color schemes. Decorative strip 50 includes a transversely extending portion 52 which covers the transversely extending portion 32 of the insert 30.

Projecting legs 54, 56 extend over the edges 24, 26 of the panel 20 and 22, thereby covering the edges so that shoppers cannot be injured by bumping against the edges 24, 26. Since the decorative strip 50 is vinyl or a similar flexible or semi-flexible material, no sharp edges, fasteners, etc. project from the end member 18 to injury shoppers. The decorative strip 50 is secured to the insert 30 by a projecting leg 58 which projects from the transversely extending portion 52 at substantially the midpoint thereof. Deflectable arms 60, 62 extend transversely from the arm 58. The vinyl strip 50 is applied to the insert by forcing (with, if necessary, heat) the projecting portion 58 into the cavity 44 of the recess 42, thereby causing the deflectable arms 60 and 62 to deflect over the rims 48, 46 so that when the arms 58, 60 relax to engage the rims 48, 46 the trim strip 50 will be secured to the insert 30. However, the insert 30 and strip 50 are both made of semi-rigid, flexible material so that the trim strip 50 may be easily pulled off the insert 30, legs 60, 62 being deflected around the rims 48 and 46. Accordingly, the strip 50 may be applied in the field after the display case 10 is manufactured, so that the color of the trim strip 50 may be compatible with the color scheme of its environment. It will be noted that, and referring to FIG. 1, opposite ends 64, 66 of the trim strip 50 are located so that they engage the bottom edge 68 of the end member 18 when pressed against the floor of the supermarket and thus will be concealed from view.

Figure 5:
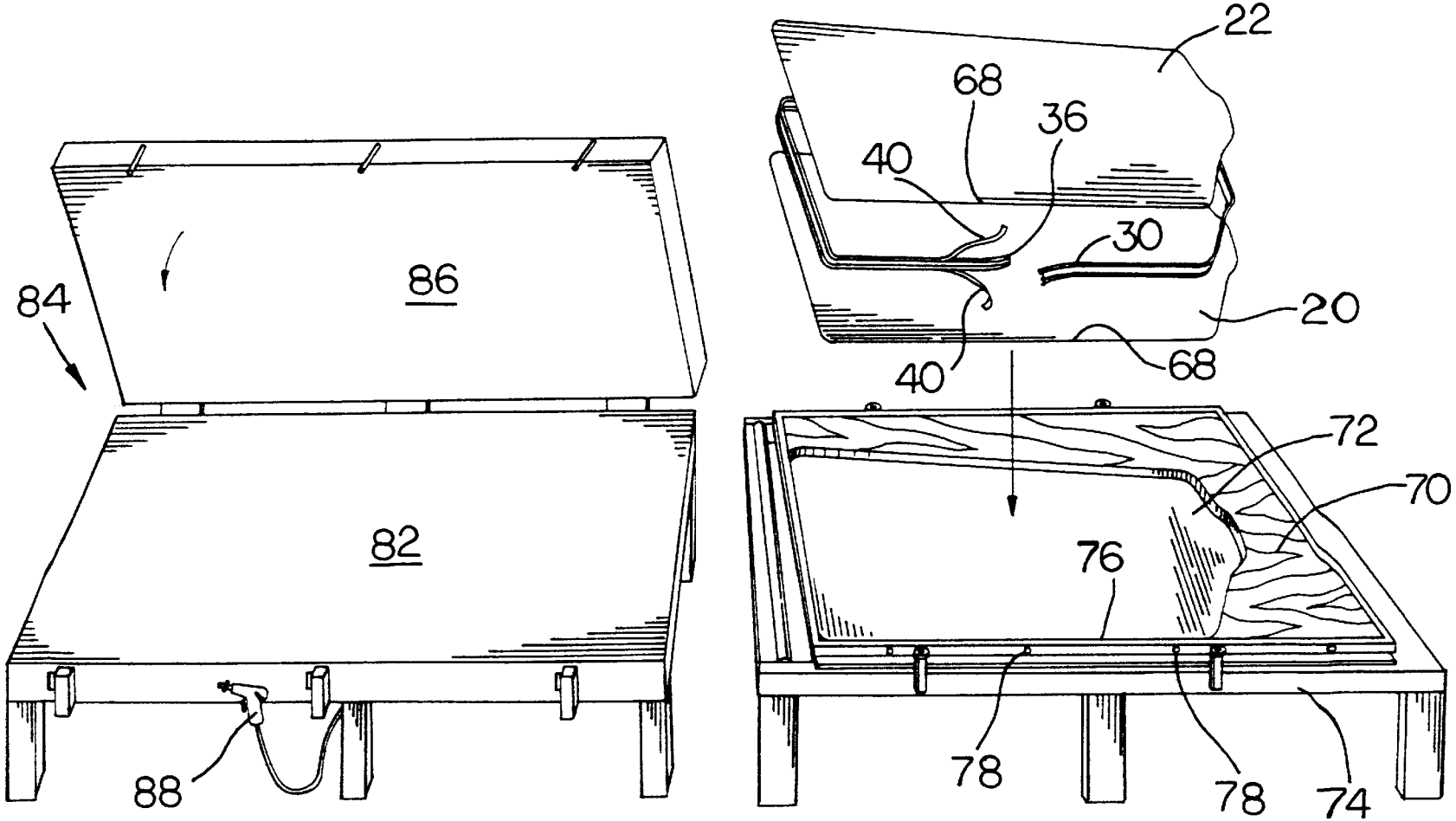
FIG. 5 is an exploded view in perspective of a jig and press used in the method of manufacturing the end member of the present invention, the panels and the flexible insert being shown lifted off of the jig.
Figure 6:
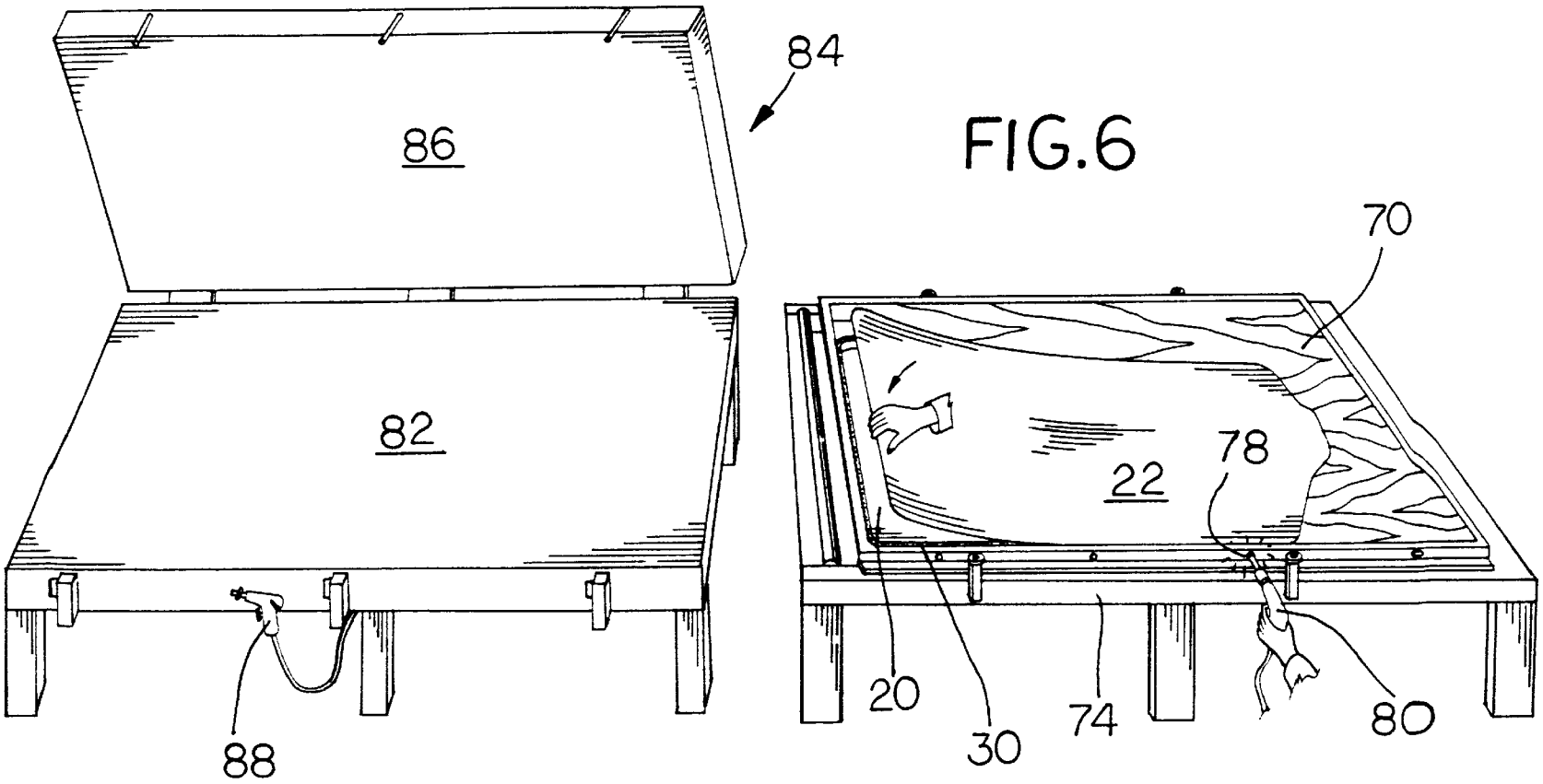
FIG. 6 is a view similar to FIG. 5, but showing the panels and flexible insert installed in the jig.
Figure 7:
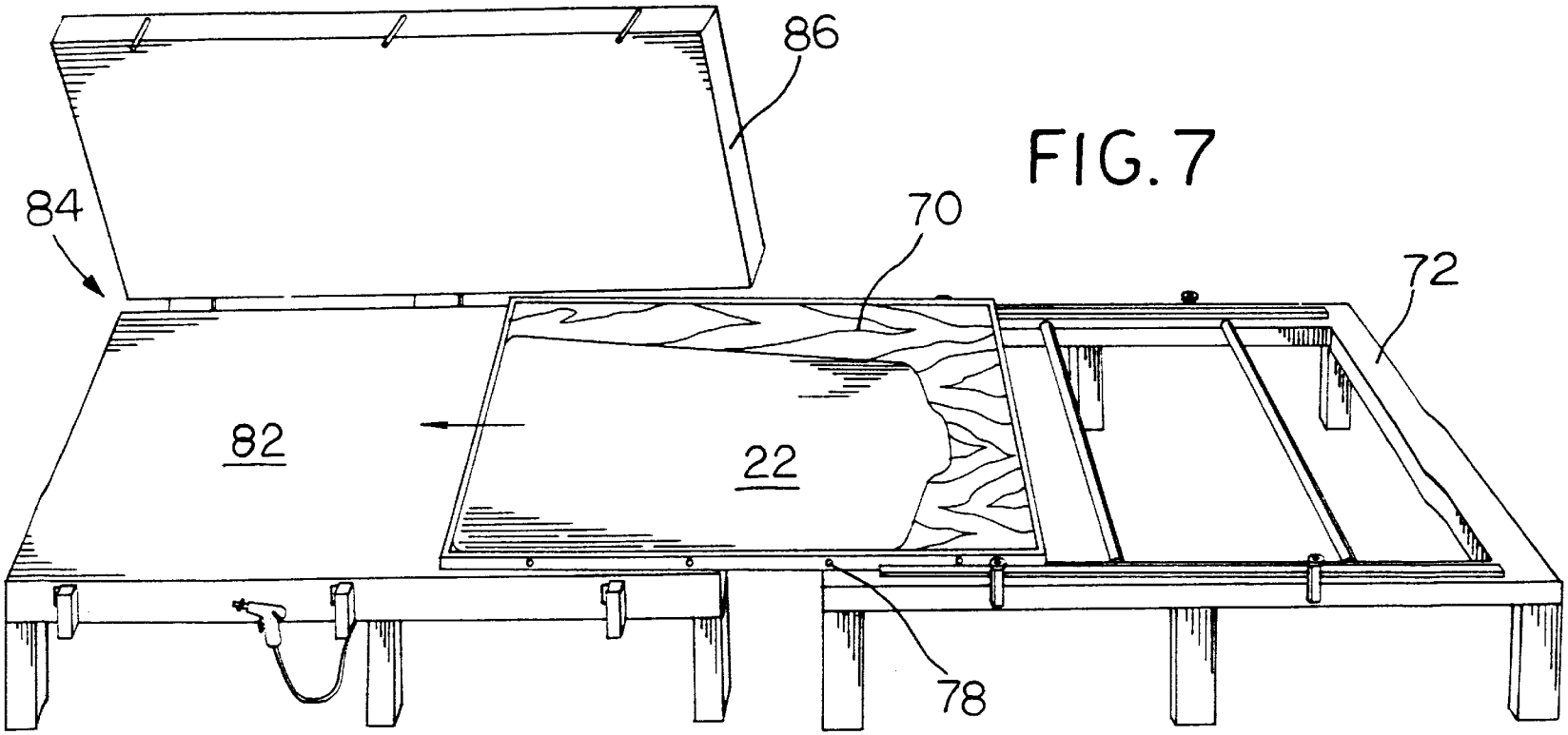
FIG. 7 is a view similar to FIG. 6, showing the jig with the panels and insert installed therein being moved into the press.
Figure 8:
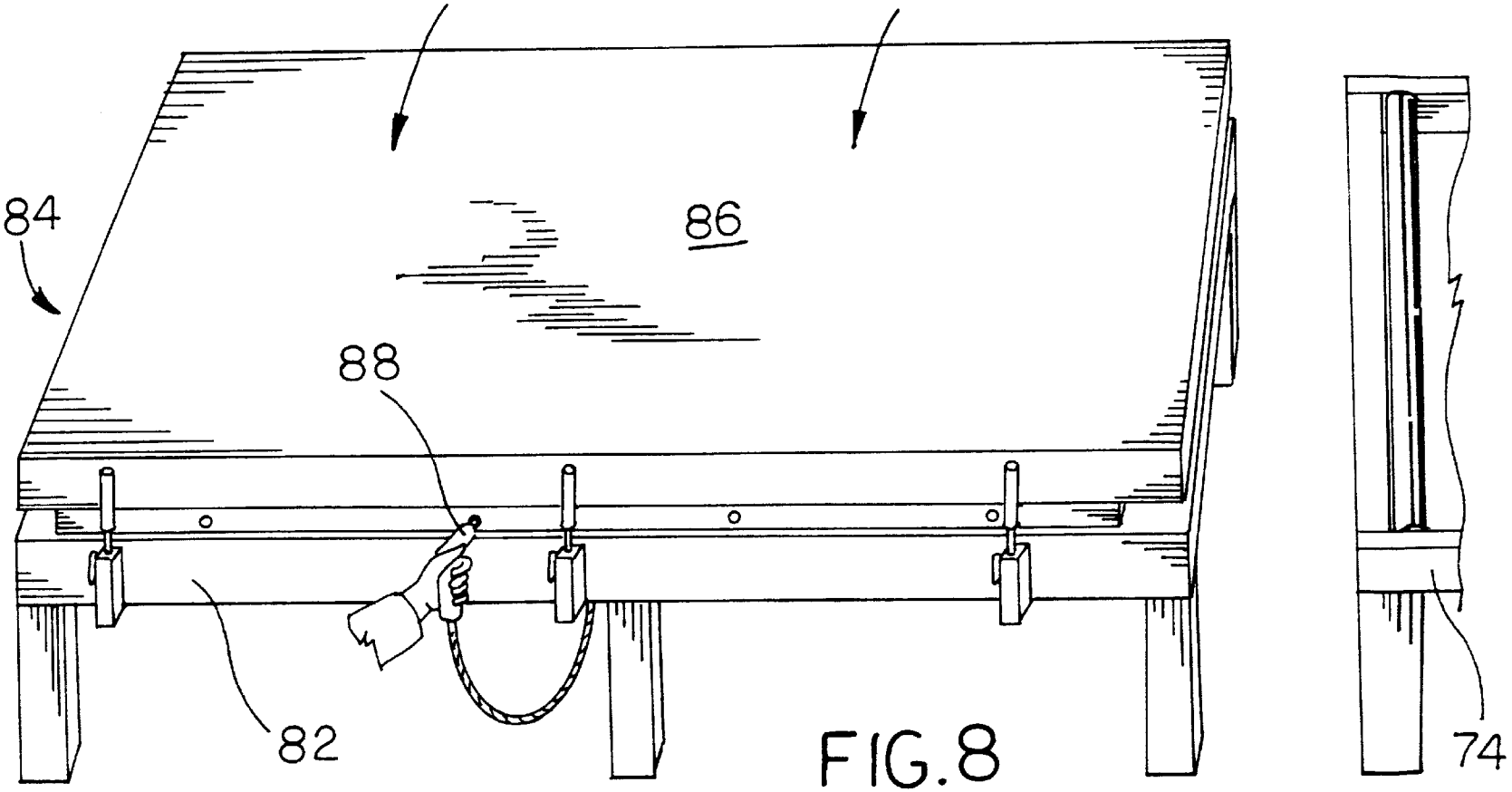
FIG. 8 is a view of a portion of FIG. 7 illustrating the top of the press being closed and foam material being injected into the end member of the present invention.
Figure 9:
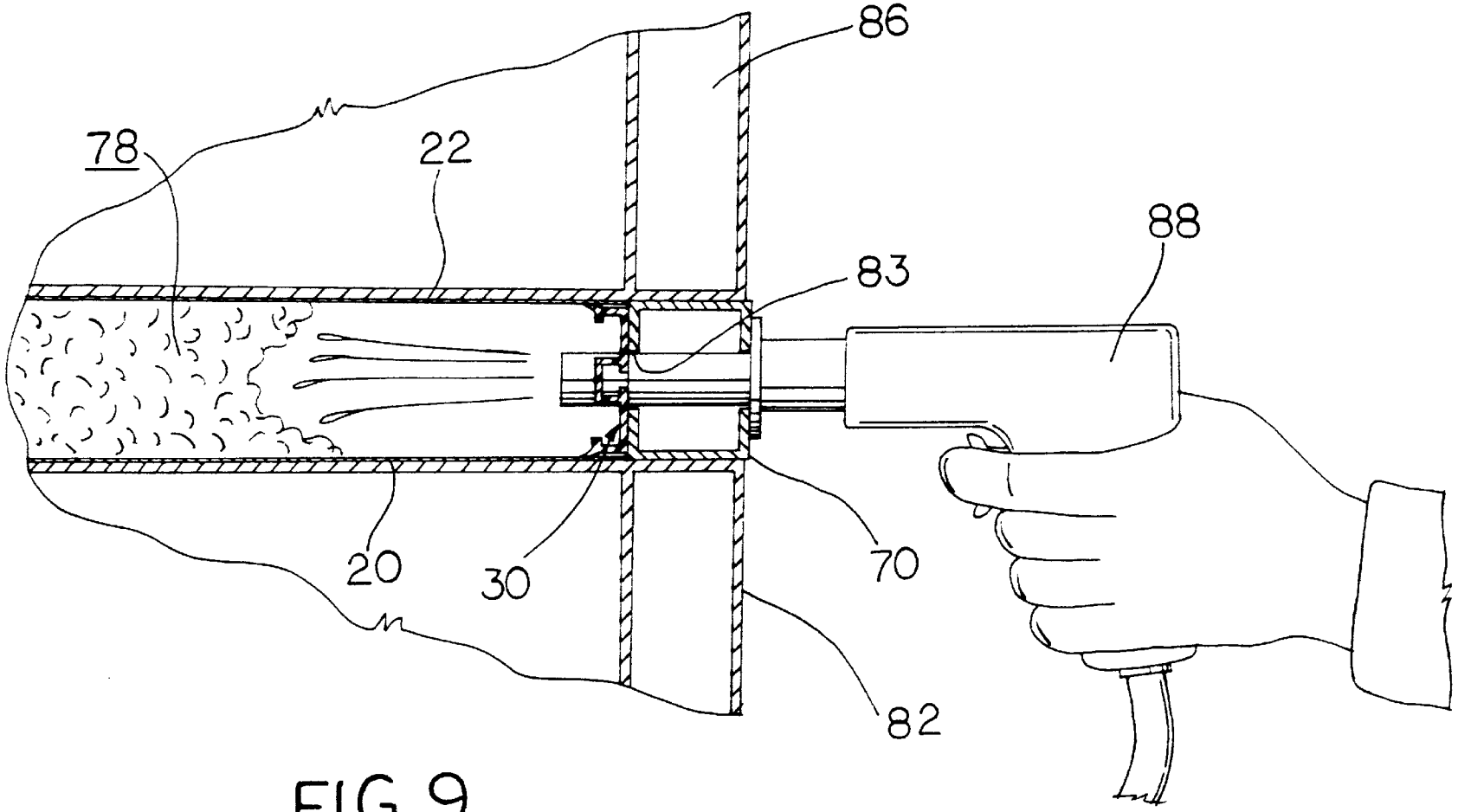
FIG. 9 is a cross sectional view of through the press, the jig, and the end member illustrating the manner in which a foam insulation material is installed within the cavity defined within the end member.

Referring now to FIGS. 5–9, the method in which the end member 18 is manufactured will be described. Referring to FIG. 5, a jig 70 with a cut out 72 of the shape of the end member to be manufactured is slidably supported on a jig table 74. One of the panels 20 or 22 (in this case, the panel 20) is laid into the cut out 72 and the paper strip 40 is removed from the inwardly extending portion 34 of the insert 30 as the insert is pressed down along the perimeter of the panel 20. The other panel 22 is placed in the recess 72 against the inwardly extending portion 36. Accordingly, the insert 30 supports the panel 22 off the panel 20 so that the panels 20 and 22, and the insert 30 define a cavity. The bottom edge 68 of the panels is placed in the cut out 72 so that they rest against the reinforcement 76 of the jig 72. The reinforcement 76 is provided with spaced apertures 78. As shown in FIG. 6, a standard electric drill 80 is used to drill through one or more of the apertures 78 to drill holes 83 in the insert 30 to provide access to the cavity. Preferably, this aperture is drilled along that portion of the insert 30 supporting the bottom edge 68 of the panels, so that the opening will not be visible on the edges of the end member 18 normally visible. After one or more of the holes 83 is drilled in the insert 30, the jig 70 with the panels 20, 22 and insert 30 in place, is transferred off of the jig table 74 and onto the bed 82 a press 84. The lid 86 is then closed against the jig 70 to assure that the panels 20 and 22 along with the insert 30 remain in place while, as shown in FIG. 9, foam 28 is injected through the opening 82 in the insert 30 by conventional foam gun 88. The lid of the press 86 is then opened and the end member 18 is removed from the jig 70.

The end member 18 is now complete except for the application of the decorative strip 50. This decorative strip can be applied before the termination end is installed on the food display case 10 or, preferably, the strip may be applied afterwards, even after the food display case 10 has been shipped to the supermarket. Since the application or removal of the decorative strip 50 is relatively easy, the production of the partially completed end members may be continuous, and the decorative strip applied after installation of other end members on the food display case. As discussed above, the decorative strip 50 may also be easily removed from the display case and replaced.

What is claimed:

1. A food display case comprising a longitudinally extending front wall, a longitudinally extending rear wall, a transversely extending end member defining an end of the food display case, said front wall said back wall and said end member cooperating with a transversely extending wall to define a food storage area, said end member including, a pair of substantially parallel panels, each of said panels having an outer edge offset from the outer edge of the other panel, said outer edges of the panels defining the perimeter of the end member, a perimetrically extending, semi-rigid, flexible, insert extending around said perimeter, said insert including a transversely extending portion extending between said panels and a pair of inwardly extending members extending into said cavity substantially parallel to said panels, said inwardly extending members being secured to a corresponding one of said panels to secure the insert to the panels, said insert and said panels cooperating to define a cavity, an insulating material in said cavity, and a semi-rigid, flexible decorative strip extending around said perimeter to cover at least a portion of said insert, said strip and said insert including retaining means securing said strip onto the insert.

2. End member as claimed in claim 1, wherein retaining means is a releasable retaining means permitting said decorative strip to be removed from said insert and replaced with a different decorative strip.

3. End member as claimed in claim 2, wherein said releasable retaining means includes an inwardly projecting portion of said decorative strip projecting toward said insert and engaging a recess in said insert to retain the strip on the insert.

4. End member as claimed in claim 3, wherein said retaining means includes a perimetrically extending rim projecting into said recess, said inwardly projecting portion including a deflectable arm deflecting around said rim when the strip is pressed against the insert but releasing to engage said rim to retain the strip onto the insert.

5. End member as claimed in claim 4, wherein said recess projects into said cavity and extends around said perimeter parallel to said edges.

6. End member as claimed in claim 1, wherein said insert includes a transversely extending portion extending between said panels and a pair of inwardly extending members extending into said cavity substantially parallel to said panels, one of said inwardly extending members being secured to a corresponding one of said panels to hold the insert in place.

7. End member as claimed in claim 6, wherein said one inwardly extending members is secured to said corresponding panel by an adhesive applied to said inwardly extending portion.

8. End member as claimed in claim 6, wherein apertures are provided in said insert communicating with said cavity.

* * * * *